United States Patent [19]

Moore et al.

[11] 4,245,284

[45] Jan. 13, 1981

[54] ELECTRIC LIGHTING FIXTURE AND GLOBE SUPPORT

[75] Inventors: Kenneth M. Moore, Parkersburg, W. Va.; Frank N. Cotten, Cincinnati, Ohio

[73] Assignee: Union Insulating Company, Parkersburg, W. Va.

[21] Appl. No.: 48,210

[22] Filed: Jun. 13, 1979

[51] Int. Cl.[1] ..... F21V 3/00

[52] U.S. Cl. ..... 362/311; 362/370; 362/432

[58] Field of Search ..... 362/368, 370, 362, 432, 362/145, 146, 147, 801, 311

[56] References Cited

U.S. PATENT DOCUMENTS

| | | | |
|---|---|---|---|
| 2,909,653 | 10/1959 | Diedring | 362/311 |
| 3,101,908 | 8/1963 | Moore | 362/311 |
| 3,114,182 | 12/1963 | Trautner et al. | 362/311 |
| 3,115,308 | 12/1963 | Stark | 362/311 |
| 3,210,532 | 10/1965 | Woofter et al. | 362/311 |

*Primary Examiner*—Monroe H. Hayes

*Attorney, Agent, or Firm*—Jerry F. Janssen

[57] ABSTRACT

An electrical lighting fixture of the sidewall type comprises a mounting or base section and a lamp and globe carrying section which are assembled by a snap-fit action.

3 Claims, 8 Drawing Figures

ELECTRIC LIGHTING FIXTURE AND GLOBE SUPPORT

BACKGROUND OF THE INVENTION

This invention relates to electric lighting fixtures. More particularly, the invention is concerned with electric lighting fixtures of the type having a mounting bracket containing a socket for a lamp and a removable shade or globe for the latter.

Lighting fixtures of a widely used type are disclosed in U.S. Pat. No. 3,101,908 to Kenneth M. Moore. These lighting fixtures have been manufactured preferably in two sections. One section provides a mounting base, and the other section provides a lamp socket and a globe or shade receiving section, the two sections having interengaged parts so that the sections may be assembled and held together by a single screw, rivet, or similar fastener. Lighting fixtures so manufactured require the additional manufacturing steps of providing the hole or holes to receive the fastener and the insertion of the fastener in order to assemble the parts.

SUMMARY OF THE INVENTION

An improved electric lighting fixture of the sidewall type according to the present invention comprises a base section and a lamp carrying section. The base section comprises an attaching portion and an integral arm projecting outwardly therefrom. The arm is hollow and has a top wall, a closed outer end wall, side walls, and a short bottom wall connecting the portions of the side walls which are adjacent to the attaching portion of the base section. The outer end wall, short bottom wall, and side walls of the arm provide the arm with a downwardly facing opening. The outer end wall of the arm has a first latching means comprising a protrusion extending from the arm into the opening.

The lamp carrying section comprises a top wall and a depending peripheral wall of a size and shape to receive the neck of a globe or shade. The lamp carrying section also includes a lamp socket housing disposed in the top wall of the lamp carrying section. The lamp carrying section closes the opening in the arm, the top wall of the lamp carrying section abutting the lower edges of the side walls and the bottom edge of the end wall, with the depending peripheral wall abutting the outer edge of the short bottom wall of the arm.

A first engaging means on the short bottom wall of the arm, and a second engaging means on the depending peripheral wall of the lamp carrying section coact to provide support for the lamp carrying section adjacent to the short bottom wall of the arm.

A second latching means, comprising a protrusion extending from the lamp carrying section, coacts with the first latching means extending from the outer wall of the arm to provide support for the lamp carrying section adjacent to the outer wall of the arm.

Figure 1:
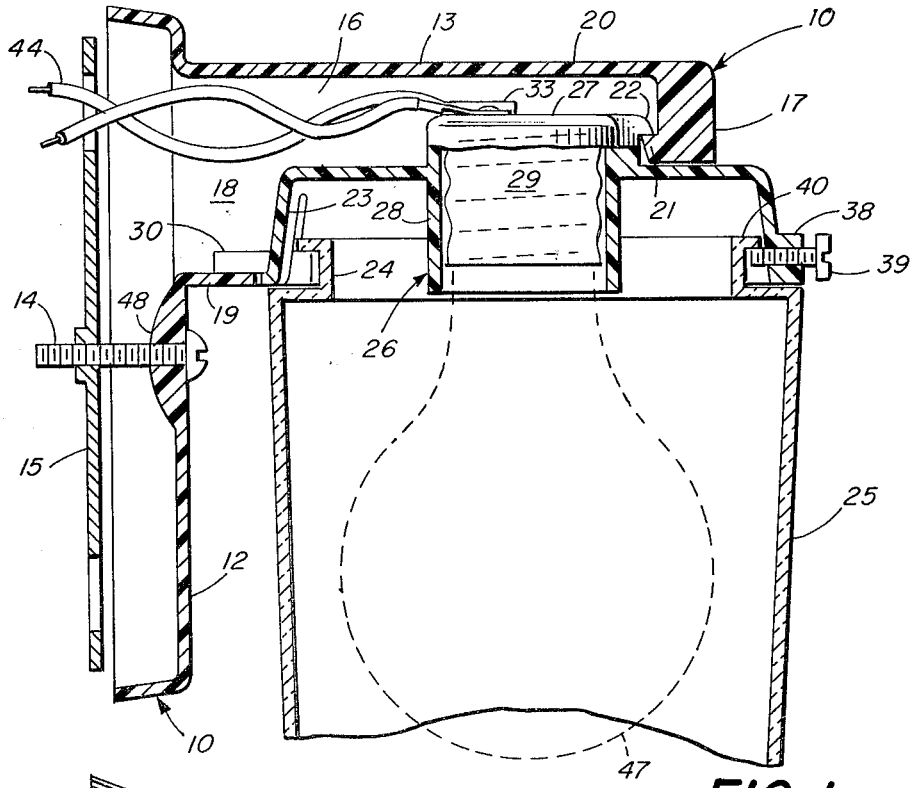
FIG. 1 is a vertical, sectional view through an electric lighting fixture in accordance with the present invention, a portion of the globe mounted thereon with parts being in elevation and parts broken away.

For a better understanding of the present invention together with other and further objects, advantages and capabilities thereof, reference is made to the following disclosure and appended claims in connection with the above-described drawings.

DETAILED DESCRIPTION

Referring in greater detail to the drawings, one embodiment of electric lighting fixtures according to the present invention is shown in which the numerals 10 and 11 represent the two sections of the fixture. The sections are preferrably fabricated from a moldable plastic insulating material, such as a phenolic resin. The main or base section 10 is generally of a right angular shape when viewed from the side and comprises an attaching portion or plate 12 which can be round, rectangular or many variations thereof, and arm 20 extending laterally therefrom. The mounting or attaching portion 12 may be fastened against a wall or ceiling in any suitable manner, but as shown there is a centrally positioned screw or bolt 14 threaded into a hole in the center of a metal attaching plate 15. The arm 20 is formed of a top wall 13, short side walls 18, a closed outer end wall 17, and a short bottom wall 19 which connects those portions of the side walls 18 which are adjacent to the attaching portion 12. The arm 20 is generally hollow having a passageway or hollow region 16 to permit the passage of electrical conductors or wires 44. The top wall 13, the outer end wall 17, the short side walls 18, and the short bottom wall 19, provide the arm 20 with a downwardly facing opening. This opening is closed by the lamp carrying section 11. The top wall 32 of the lamp carrying section 11 abuts the bottom edge of the side walls 18 and the outer end wall 17 of the arm 20. The depending peripheral wall 23 of the lamp carrying section 11 abuts the outer edge of the bottom wall 19 of the base or main section 10.

Figure 8:
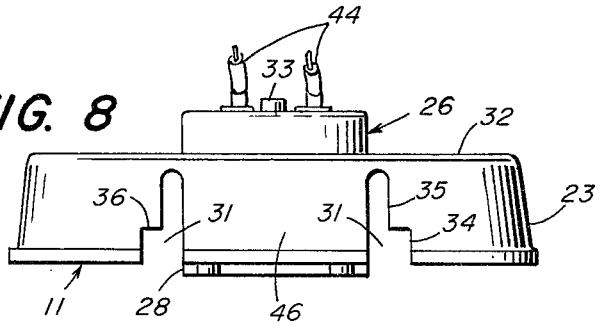
FIG. 8 is a rear view of the lamp carrying section of the fixture.
Figure 6:
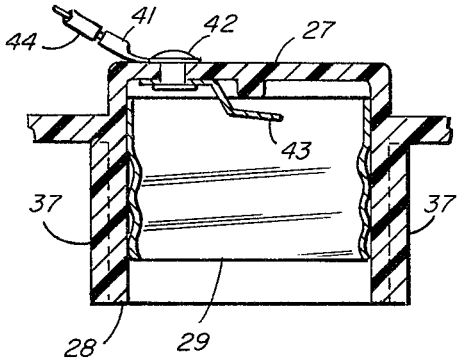
FIGS. 6 and 7 are detailed sectional views of the lamp socket housing taken from the line 6—6 and 7—7, respectively, in FIG. 2, on an enlarged scale.
Figure 7:
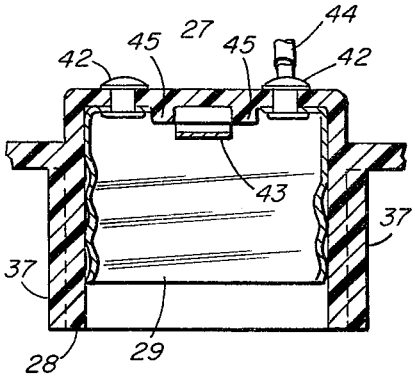

A first engaging means on the short bottom wall 19 of the arm 20 coacts with a second engaging means on the depending peripheral wall 23 of the lamp carrying section 11 to provide support for the lamp carrying section adjacent to the short bottom wall 19 of the arm 20. In the preferred embodiment of the present invention the first engaging means comprises two projections 30 attached to the short bottom wall 19 of the arm 20 and extending outwardly therefrom. As shown in FIG. 8, the second engaging means comprises a pair of openings in the depending peripheral wall 23 of the lamp carrying section 11, spaced apart to receive the projections 30. In the preferred embodiment of the present invention, the openings in the depending peripheral wall 23 are two slots 31 spaced apart on the depending peripheral wall 23 of the lamp carrying section 11 so as to receive the projections 30 extending from the short bottom wall 19 of the arm 20. The slots 31 have a region of a first width 34 adjacent to the bottom edge of the depending peripheral wall 23. The first width 34 is generally equal to the width of the projections 30 extending from the short bottom wall 19 of the arm 20. The slots 31 have a region of a second width 35 narrower than the first width 34 extending upward from the region of first width 34 toward the top wall 32 of the lamp carrying section 11. The region of first width 34 and second width 35 of the slots 31, provide a shoulder 36. When the lamp carrying section 11 is assembled with the main or base section 10 of the lighting fixture, the top surface of the projections 30 abut the shoulder 36 of the slots 31 in the lamp carrying section 11, providing support for the lamp carrying section 11 adjacent to the short bottom wall 19.

In the preferred embodiment of the present invention, the narrow regions 35 of the slots 31 extend upward in the peripheral wall 23, ending close to the top wall 32 of the lamp carrying section 11. There is thus provided between the slots 31, a region 46 of the depending peripheral wall 23 which has a degree of flexibility or resiliency. In an assembled lighting fixture of the type contemplated in this invention, the flexible region 46 of the depending peripheral wall 23 bears against the outer edge of the short bottom wall 19 of the arm 20 biasing or urging the lamp carrying section 11 in a direction outward or away from the short bottom wall 19.

The outer end wall 17 of the arm 20 is provided with a first latching means which, in the preferred embodiment of the present invention, comprises a protrusion 21 attached to or integral with the outer end wall 17 extending into the opening of the arm 20. A second latching means comprises a protrusion 22 attached to or integral with the lamp carrying section 11. In the preferred embodiment of the present invention, the lamp socket housing 26 extends upwardly through the top wall 32 of the lamp carrying section, and the protrusion 22 constitutes a portion of the cylindrically depending wall 28 of the lamp socket housing 26 or its top wall 27.

As shown in FIG. 1, the first protrusion 21 and second protrusion 22 are generally hook-shaped with flat mating surfaces and opposite rounded or beveled surfaces. When the lamp carrying section 11 is assembled with the base or main section 10, the projections 30 on the short bottom wall 19 of the arm 20 are inserted in the slots 31 of the lamp carrying section 11. The lamp carrying section is then urged upward to close the opening in the arm 20 until the top wall 32 of the lamp carrying section 11 abuts the lower edge of the side walls 18 and the end wall 17 of the arm 20. As the lamp carrying section 11 is urged into place, interaction of the rounded or beveled surfaces of the first protrusion 21 and the second protrusion 22 urges or biases the lamp carrying section 11 in a direction away from the outer end wall 17 of the arm, and toward the short bottom wall 19. The strain which this action places upon the depending peripheral wall 23 of the lamp carrying section 11 is absorbed by the flexible section 46 of the depending wall 23. When the first protrusion 21 and second protrusion 22 snap into position, that strain is partially relieved, and the lamp carrying section 11 is urged or biased in a direction toward the outer end wall 17 by the action of the flexible portion 46 of the depending peripheral wall 23 bearing against the outer edge of the short bottom wall 19.

Electric lighting fixtures constructed in accordance with the present invention thus comprise two pieces which easily can be assembled by a snap-fit action, obviating the need for a screw, bolt, rivet, or similar fastener to attach one portion to the other. Fixtures constructed in accordance with this invention thus possess a simpler design which results in a savings of material and time in their manufacture.

Figure 2:
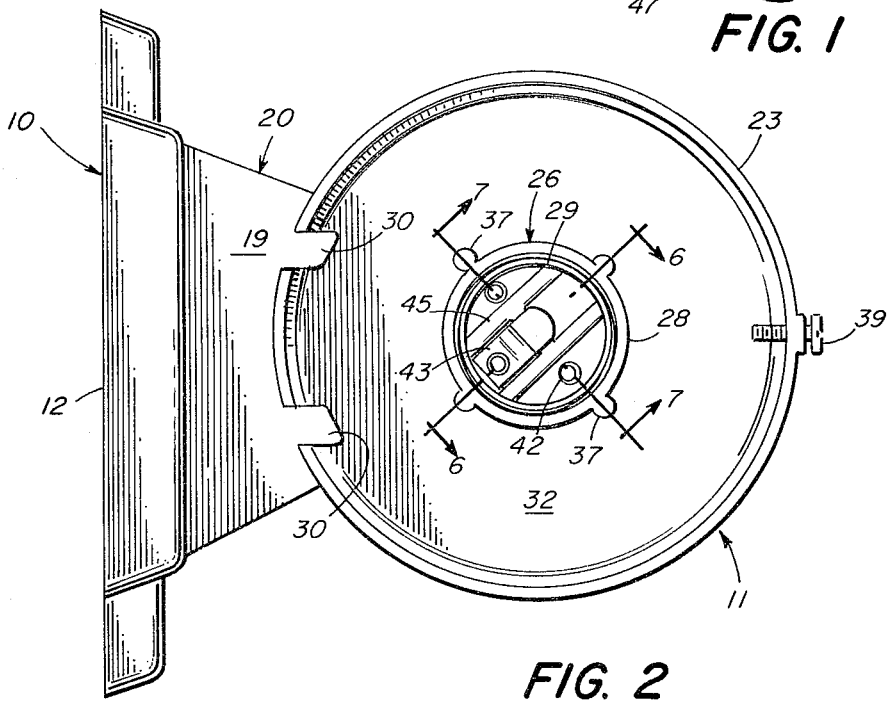
FIG. 2 is a bottom view of the electric lighting fixture, the globe being omitted.
Figure 4:
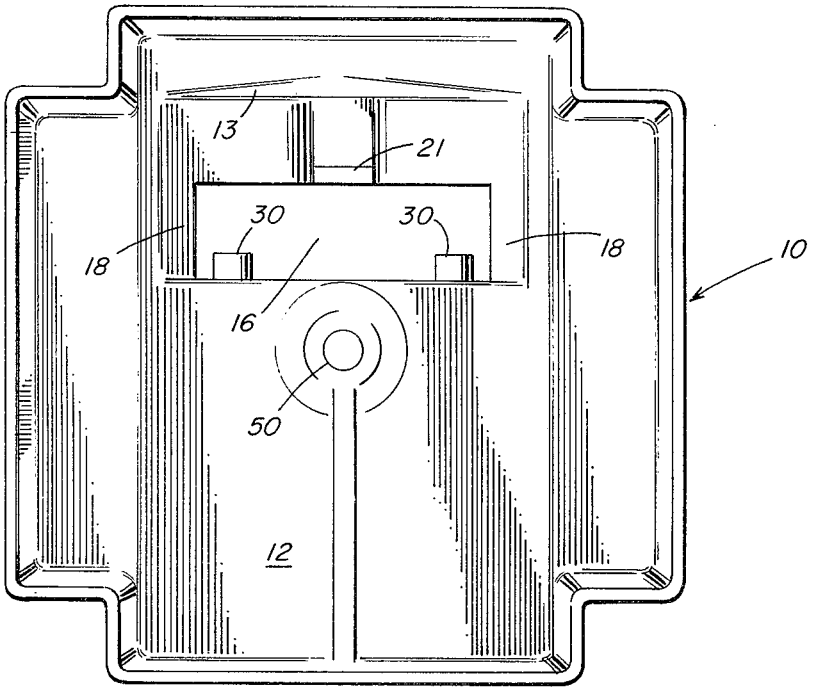
FIG. 4 is a rear view of the base section of the fixture.
Figure 3:
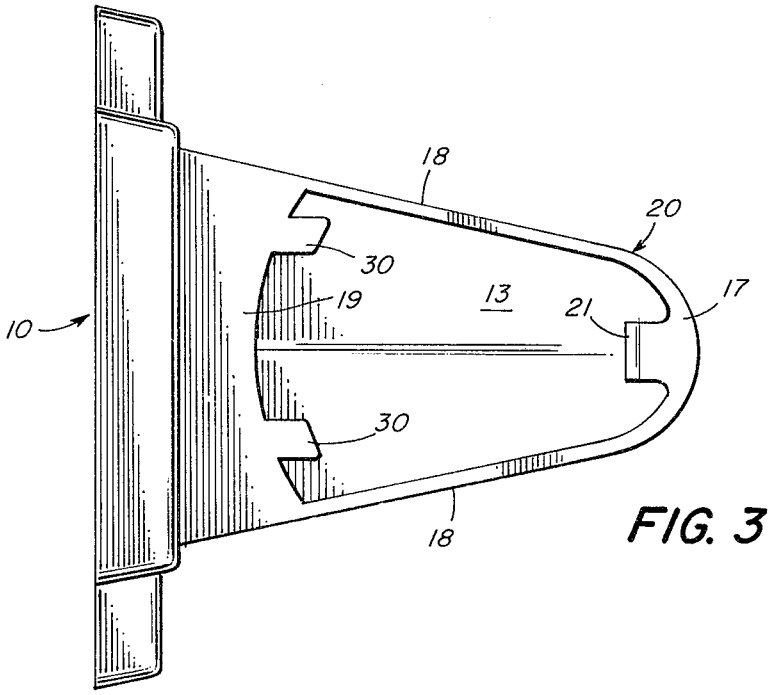
FIG. 3 is a bottom view of the main or base section of the fixture.
Figure 5:
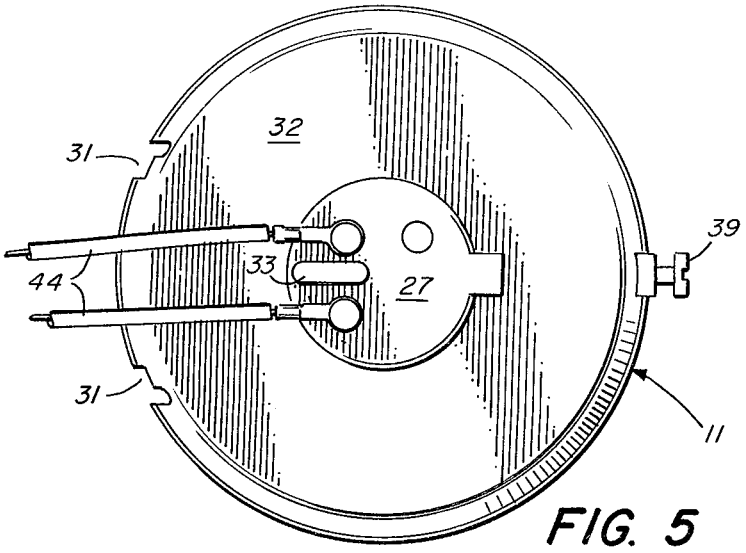
FIG. 5 is a top view of the lamp and globe carrying section of the fixture.

As shown in FIGS. 1 and 2, the projections 30 on the short bottom wall 19 extend through the openings or slots 31 in the depending peripheral wall 23 of the lamp carrying section 11 in order to engage the neck of a globe or shade which can be attached to the lamp carrying section 11. Support for the globe or shade adjacent to the short bottom wall 19 is provided by the extensions of the projections 30 lying under the bead 40 of the globe or shade 25. A fastener 39 generally diametrically opposed to the projections 30, on the depending peripheral wall 23 of the lamp carrying section 11 provide additional support for the globe or shade 25. In the preferred embodiment of the invention, this fastener comprises a bolt or screw 39 threaded into an opening 38 in the depending peripheral wall 23 of the lamp carrying section 11.

Electrical connection to the lamp is provided by attaching an electrically conductive lamp socket 29 in the lamp socket housing 26 by means of rivets or similar fasteners 42. A central electrical connection 43 is attached to the lamp socket housing 26 by means of a rivet or similar fastener 42. Electrical conductors or wires 44 are attached to the appropriate electrical connections on the lamp socket housing 26 by means of solderless wiring lugs 41 or similar electrical connectors, and rivets 42 or similar fasteners.

While there has been shown and described what is at present considered the preferred embodiment of the invention, it will be obvious to those skilled in the art that various changes and modifications may be made therein without departing from the scope of the invention as defined by the appended claims.

What is claimed is:

1. An electric lighting fixture comprising:

a base section having an attaching portion and an integral arm projecting outwardly therefrom;

said arm being hollow and having a top wall, a closed outer end wall, side walls, and a short bottom wall connecting the portions of said side walls adjacent to the attaching portion of said base section;

said outer end wall, short bottom wall, and side walls providing said arm with a downwardly facing opening;

said outer end wall having a first latching means comprising a protrusion integral therewith and extending into said opening;

a pair of projections spaced apart on said short bottom wall of said arm; and a lamp carrying section closing the opening in said arm, the lamp carrying section comprising a top wall and depending peripheral wall of a size to receive the neck of a globe;

the top wall of said lamp carrying section abutting the lower edges of said side walls, the bottom edge of said end wall, and the outer edge of said short bottom wall of said arm;

said lamp carrying section including a lamp socket housing disposed in the top wall of said lamp carrying section;

a pair of slots in said depending peripheral wall spaced apart to receive said pair of projections, said pair of projections and said pair of slots coacting to provide support for the lamp carrying section adjacent to the short bottom wall of said arm;

said slots having a region of a first width to receive said projections and a region of a second narrow width whereby there is provided between said pair of slots a resilient section in said depending peripheral wall; and a second latching means comprising a protrusion integral with said lamp carrying section;

whereby said resilient section of said depending peripheral wall bears flexibly against the front edge of said short bottom wall, urging said second latching means toward said first latching means, said first and second latching means coacting to provide support for the lamp carrying section adjacent to the outer end wall of said arm.

2. An electric lighting fixture according to claim 1 wherein said projection on the short bottom wall of said arm extends through said opening in the depending peripheral wall of said lamp carrying section, said projection extending beyond said depending peripheral wall and being of a length to engage and provide support adjacent to said short bottom wall for that portion of the neck of a globe disposed in said lamp carrying section.

3. An electric lighting fixture according to claim 1 including a single fastener element disposed in the depending peripheral wall of said lamp carrying section at a point substantially diametrically opposite said projection and engageable with the neck of a globe disposed in said lamp carrying section, said fastener element coacting with said projection to support the globe in said fixture.

* * * * *